US005647306A

United States Patent [19]

Pateman

[11] Patent Number: 5,647,306

[45] Date of Patent: Jul. 15, 1997

[54] ASSEMBLY OF AUXILIARY APPARATUS FOR AN INTERNAL COMBUSTION ENGINE

[75] Inventor: Richard Pateman, Peterborough, United Kingdom

[73] Assignee: Perkins Limited, Peterborough, United Kingdom

[21] Appl. No.: 656,359

[22] PCT Filed: Sep. 29, 1995

[86] PCT No.: PCT/GB95/02321

§ 371 Date: Jun. 14, 1996

§ 102(e) Date: Jun. 14, 1996

[87] PCT Pub. No.: WO96/12093

PCT Pub. Date: Apr. 25, 1996

[30] Foreign Application Priority Data

Oct. 14, 1994 [GB] United Kingdom ..... 9420821

[51] Int. Cl.[6] ..... F01P 11/08

[52] U.S. Cl. ..... 123/41.33; 123/196 A; 123/196 AB

[58] Field of Search ..... 123/4.33, 196 A, 123/196 AB, 41.44

[56] References Cited

U.S. PATENT DOCUMENTS

| | | | |
|---|---|---|---|
| 2,067,421 | 1/1937 | Sergardi | 123/196 |
| 2,730,083 | 1/1956 | Kremser | 123/41.33 |
| 4,370,957 | 2/1983 | Skatsche et al. | 123/41.33 |

FOREIGN PATENT DOCUMENTS

| | | |
|---|---|---|
| 1193310 | 5/1965 | Germany . |
| 1271461 | 6/1968 | Germany . |
| 4029408 | 3/1992 | Germany . |
| 2112918 | 7/1983 | United Kingdom . |

*Primary Examiner*—Noah P. Kamen

*Attorney, Agent, or Firm*—Nilles & Nilles, S.C.

[57] ABSTRACT

An assembly of auxiliary apparatus for an internal combustion engine includes a coolant pump, an oil cooler device, and an oil filter unit combined and interconnected as a unitary unit for mounting on the internal combustion engine. The oil cooler device includes a housing having an oil pathway and a coolant pathway formed therein. The pathways are arranged to allow heat exchange between oil and coolant flowing through the pathways. The housing has a mounting surface for attachment to the internal combustion engine such that the oil pathway and the coolant pathway both extend beyond the mounting surface and into a recess of a wall of the engine. The assembly allows the engine envelope size to be reduced.

18 Claims, 2 Drawing Sheets

ASSEMBLY OF AUXILIARY APPARATUS FOR AN INTERNAL COMBUSTION ENGINE

BACKGROUND OF THE INVENTION

1. Field of the Invention

This invention relates to an assembly of auxiliary apparatus for an internal combustion engine; an internal combustion engine including the assembly; and a unitary base structure for the assembly.

2. Description of the Prior Art

A number of assemblies combining auxiliary apparatus such as oil filter units and oil cooler devices are known. These assemblies are generally designed for external mounting on internal combustion engines. Such assemblies are provided to reduce engine envelope size and to reduce the number of connecting conduits between the auxiliary apparatus in order to reduce the number of possible leakage paths and facilitate installation and maintenance of said auxiliary apparatus.

U.S. Pat. No. 4370957 discloses an assembly of auxiliary apparatus comprising an oil cooler device and a twin oil filter unit, together with an oil pump and a coolant pump which share a common drive shaft. The oil cooler device housing has a mounting surface for attachment to an engine and a flange for mounting the coolant pump, upon which is provided a further flange for mounting the oil pump. The auxiliary apparatus can be interchanged separately although, except in the case of the oil filters and the oil pump, not without disturbing at least one other piece of apparatus.

The mounting surface of the oil cooler device housing is spaced from an inner wall of the housing which, together with other walls of the housing, generally encloses an oil pathway and a coolant pathway, the arrangement being such that when the assembly is attached to an engine the inner wall is located on a side of the mounting surface spaced away from the engine. Whilst this assembly still allows the engine envelope size to be reduced, it does not maximize the amount by which the engine envelope size can be reduced.

OBJECTS AND SUMMARY OF THE INVENTION

It is an object of the present invention to obviate or mitigate the disadvantages of the prior art.

According to one aspect of the present invention there is provided an assembly of auxiliary apparatus for an internal combustion engine comprising a coolant pump, an oil cooler device and an oil filter unit combined and interconnected as a constructional unit for mounting on the internal combustion engine, wherein the oil cooler device comprises a housing having an oil pathway and a coolant pathway, the pathways being arranged to allow heat exchange between oil and coolant flowing through the pathways, and the housing has a mounting surface for attachment to an internal combustion engine.

Preferably, the housing is constructed as a two part sub-assembly with the oil pathway and the coolant pathway each located partly within an outer cover with their remaining portions located within an inner cover which, in use, is located in the recess in the engine and forms a part of a coolant jacket of the engine.

The outer cover includes means for attaching the cooler device to the engine cylinder block, and the inner and outer covers of the housing may be arranged such that when the outer cover is fastened to the engine, it clamps the inner cover in position.

Alternatively, the inner cover is formed, in use, by a wall of the engine.

By either of these arrangements, a reduced engine envelope can be achieved compared with the prior art in which the coolant pathway of the cooler device is spaced outwardly from a mounting surface of the oil cooler device.

The oil pathway may comprise a plate type cooler element.

Means for enabling the coolant pump to be connected to the oil cooler device may comprise a coolant pump backplate with an integral coolant inlet connection incorporated in the outer cover of the housing.

The outer cover may have further means incorporated therein to enable the oil filter unit to be connected to the oil cooler device.

Thus, the coolant pump and-oil filter unit can be separately serviced or replaced without disturbing the other apparatus comprising the assembly of the invention.

Preferably, in use, coolant flowing through the coolant pathway exits the oil cooler device housing via an aperture in the inner cover which communicates directly with the engine coolant jacket.

Preferably also, oil inlet and outlet ports in the oil cooler device housing for the coolant pathway and oil pathway respectively are arranged such that, in use, oil flows through the oil pathway in a direction relative to the housing generally opposite to a flow direction of coolant flowing through the coolant pathway.

According to a second aspect of the present invention there is provided an internal combustion engine including an assembly of auxiliary apparatus in accordance with the first aspect of the present invention.

According to a third aspect of the present invention there is provided a unitary base structure for mounting an oil cooler device, an oil filter unit and a coolant pump on an internal combustion engine comprising: a housing for at least partially enclosing, in a spaced relationship thereto, an oil cooler element; first means formed integrally with the housing and arranged to constitute a part of a coolant pump; and second means formed integrally with the housing and arranged to constitute a filter head for a replaceable filter unit, the arrangement being such that the first and second means are arranged to be closely adjacent to each other on the unitary base structure.

Preferably, the first and second means are arranged to be closely adjacent to each other at an end of the housing.

Preferably also, the housing has a mounting surface for attachment to an internal combustion engine, the arrangement being such that the oil cooler element extends beyond the mounting surface.

BRIEF DESCRIPTION OF THE DRAWINGS

The foregoing and further features of the present invention will be more readily understood from the following description of preferred embodiments, by way of example thereof, and with reference to the accompanying drawings, of which.

DESCRIPTION OF THE PREFERRED EMBODIMENTS

Figure 2:
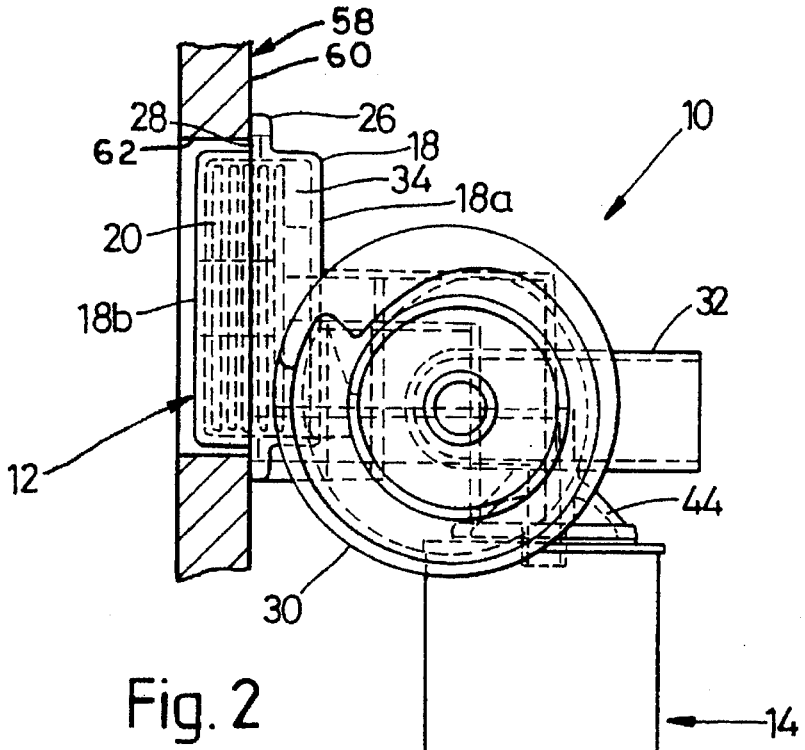
FIG. 2 is a side elevational view in a direction towards a coolant pump connection end of the assembly of FIG. 1.
Figure 3:
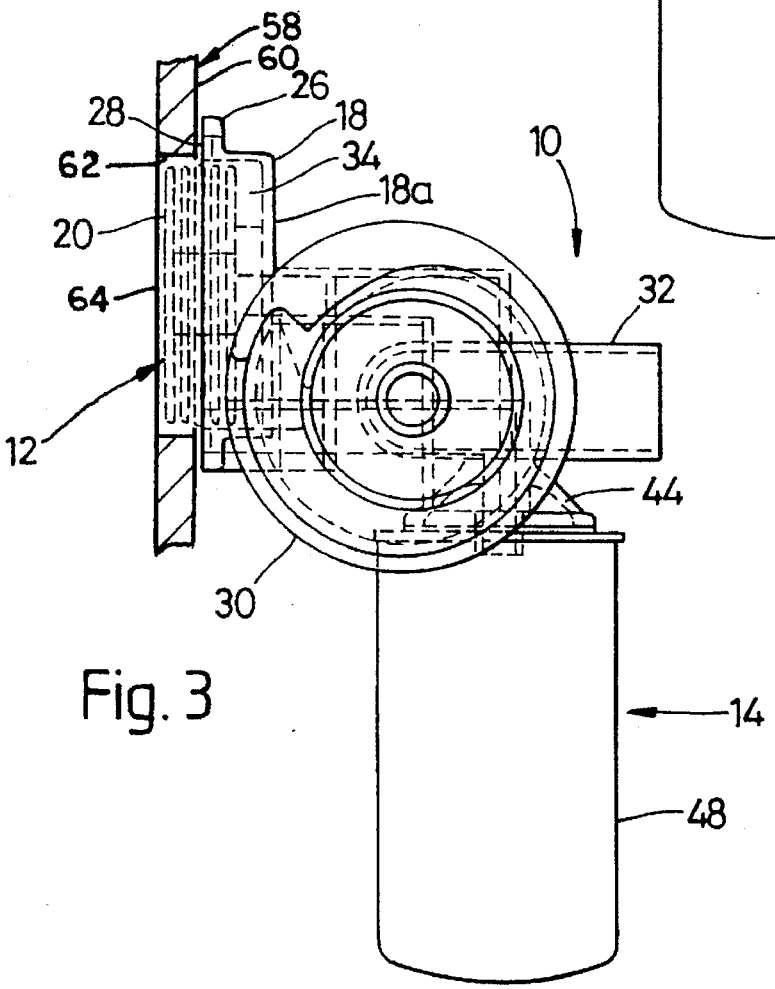
FIG. 3 is a side elevational view in a direction towards a coolant pump connection end of another embodiment of the assembly according to the present invention.

Referring to the drawings, the assembly 10 of auxiliary apparatus according to the present invention in both its embodiments comprises a plate type oil cooler device 12 which is combined and interconnected with an oil filter 14 and a coolant pump 16 to provide a constructional unit which can be readily mounted on a cylinder block 60 an internal combustion engine 58 (see FIGS. 2 and 3).

In the first embodiment the oil cooler device 12 comprises a housing 18 which is constructed as a two part sub-assembly with an oil cooler element 20 (shown in broken outline in the figures) located partly within an outer cover 18*a* of the subassembly and fastened to this via an oil inlet flange 22 and an oil outlet flange 24. The remaining portion of the oil cooler element 20 sits within an inner cover 18*b* of the sub-assembly (FIG. 2) which, in use, locates, for example in a recess in a side wall of the cylinder block 60 of the internal combustion engine and functionally forms part of a coolant jacket of the internal combustion engine. The outer cover 18*a* has means to enable it to be fastened to the cylinder block 60 and thereby clamp the inner cover 18*b* in position within the recess 62. The outer cover 18*a* may be fastened to the cylinder block 60 by any suitable means but, in both embodiments of the invention, the outer cover 18*a* is shown having a flange 26 including through-holes 28 enabling the outer cover 18*a* to be bolted to the engine cylinder block 60.

In the second embodiment of the invention (FIG. 3) the oil cooler device 12 is not provided with an inner cover 18*b* which is, in effect, replaced, in use, by a wall 64 of the engine 58.

Thus, both embodiments of the invention eliminate the need for external conduits and thereby allow a substantial reduction in engine envelope size and an improvement in assembly integrity to be achieved compared with the prior art.

In both embodiments, a coolant pump backplate 30, having an integrated coolant inlet connection 32, is incorporated at a front part of the oil cooler device outer cover 18*a*. A coolant pump 16 can be fastened to this backplate 30 and is the forwardmost part of the assembly 10. The coolant pump 16 can be serviced as a separate item without disturbing any other part of the constructional unit. This contrasts with U.S. Pat. No. 4370957 in which a coolant pump situated in a similar position in relation to the oil cooler device housing carries an oil pump and therefore to service or replace the coolant pump it is necessary to disturb the oil pump.

Figure 1:
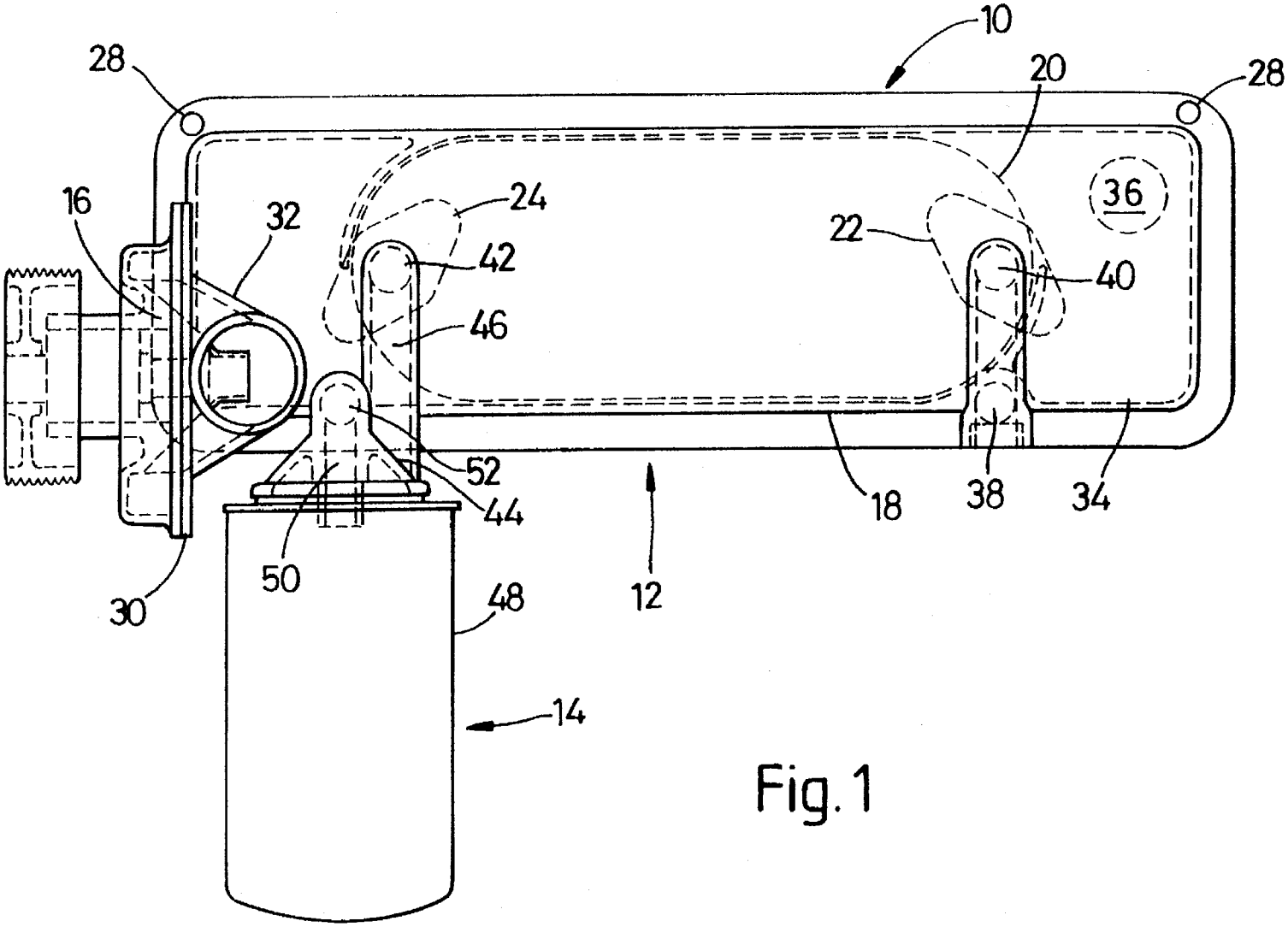
FIG. 1 is a front elevational view of an assembly of auxiliary .apparatus according to the invention.

Coolant is taken in by the coolant pump 16 and passes from the coolant inlet 32 through the oil cooler device coolant pathway 34 enclosed in the cooler device housing 18 and then passes directly into the remainder of the engine coolant jacket via an aperture 36 through the inner cover/wall of the cylinder block 60 of the of the engine (FIG. 1). This contrasts with U.S. Pat. No. 4370957 where coolant exits externally of the assembly which therefore requires an additional conduit connection to pass said coolant to the engine coolant jacket and thus does not allow the size of the oil cooler device housing to be reduced as substantially as that of the present invention.

Engine lubricating oil enters the assembly from an engine oil pump (not shown) via a bore within the cylinder block 60. This bore aligns with a bore 38 within the outer cover 18*a* of the oil cooler device 12 which then leads to an oil cooler inlet port 40. Oil passes through the oil cooler element 20 to an outlet port 42. Oil passing through the oil cooler 20 does so in a direction generally opposite to that of coolant to provide optimum oil cooling efficiency. This contrasts with U.S. Pat. No. 4370957 in which oil flow is generally in the same direction as coolant flow and thus oil cooling efficiency will be less than that of the present invention.

A lubricating oil filter adaptor 44 is an integral part of the oil cooler outer cover 18*a* at a lower front end. Oil exiting from the oil cooler element 20 passes via a passage 46 within the outer cover 18*a* to the oil filter adaptor 44 and into the oil filter canister 48. Within the canister, the oil passes around and through an oil filter element radially inwardly to a central passage (not shown). From here, having been filtered, the oil passes upwards into a further passage 50 within the filter adaptor 44 and then into the engine oil pathway via a bore 52 within the oil cooler device outer cover 18*a*.

The present invention thereby provides a lubricating oil transfer through a cooler element 20 and a filter unit 14 with a total absence of external conduits.

The assembly of the present invention is designed for high mounting on the engine 58. This optimizes the room available over the chassis rails for the mounting of a long lubricating oil filter unit. Such a filter can have a similar servicing interval to a greater number of short filters and thus give cost savings in manufacturing and in subsequent servicing.

The prior art, by means of its vertically-rising coolant inlet and outlet ports, can be assumed as being intended for low mounting on the engine. This assumption is supported by the inclusion of an oil pump which is fed from the oil pan at the base of the engine; high mounted oil pumps are not favored because of the greater time needed to charge the pump with oil on start-up after the engine has stood for a sufficient time for oil drain-back.

The present invention is configured for the inner and outer covers 18(*a,b*) to be preferably thermoset composite moldings with no requirement therefore for subsequent machining. All requirements for passages and screw thread inserts can be met during moldings. However, the inner and outer covers 18(*a,b*) may comprise metal die-castings. Even in this case there is little requirement for subsequent machining due to the configuration of the covers 18(*a,b*). This contrasts with U.S. Pat. No. 4370957 where manufacture of the oil cooler housing would be impractical without substantial jigging and drilling for some of the passages. The present invention therefore provides economic advantages over this prior art.

I claim:

1. An auxiliary assembly for an internal combustion engine, said auxiliary assembly comprising: a coolant pump, an oil cooler device and an oil filter unit combined and interconnected as a single unitary unit for mounting on the internal combustion engine, wherein said oil cooler device comprises a housing having an oil pathway and a coolant pathway formed therein, wherein said housing has a mounting surface for attachment to the internal combustion engine, and wherein the oil pathway and the coolant pathway each extend beyond the mounting surface.

2. An assembly as claimed in claim 1, wherein the housing is constructed as a two part sub-assembly including an inner cover and an outer cover, and wherein the oil pathway and the coolant pathway are each located partly within the outer cover with their remaining portions being located within the inner cover.

3. An assembly as claimed in claim 2, wherein the outer cover includes means for attaching the oil cooler device to a cylinder block of the engine.

4. An assembly as claimed in claim 2, further comprising means for connecting the coolant pump to the oil cooler device, wherein the means for connecting comprises a coolant pump backplate incorporated in the outer cover of the housing, and wherein a coolant inlet connection is formed integral with the coolant pump backplate.

5. An assembly as claimed in claim 4, wherein the outer cover further includes means for enabling the oil filter unit to be connected to the oil cooler device.

6. An assembly as claimed in claim 2, wherein an aperture is formed in the inner cover.

7. An assembly as claimed in claim 1, wherein the oil pathway comprises a plate type cooler element.

8. An assembly as claimed in claim 1, wherein inlet and outlet ports are formed in the oil cooler device housing for the coolant pathway and oil pathway, respectively.

9. A unitary base structure for mounting an oil cooler device, an oil filter unit and a coolant pump on an internal combustion engine, said base structure comprising: a housing for at least partially enclosing, in a spaced relationship thereto, an oil cooler element; a first device being formed integrally with said housing and including a part of the coolant pump; and a second device being formed integrally with said housing and including a filter head for the filter unit, the first and second devices being located closely adjacent to each other on the unitary base structure.

10. A unitary base structure as claimed in claim 9, wherein the first and second devices are located at an end of the housing.

11. A unitary base structure as claimed in claim 9, wherein the housing has a mounting surface for attachment to the internal combustion engine, and wherein the oil cooler element extends beyond the mounting surface.

12. A unitary base structure as claimed in claims 9, wherein the housing is constructed as a two part subassembly including an outer cover and an inner cover, and wherein the oil cooler element is located partly within the outer cover with its remaining portion located within the inner cover.

13. A unitary base member as claimed in claim 12, wherein the outer cover includes means for attaching the oil cooler element to a cylinder block of the engine.

14. An internal combustion engine comprising:

(A) an engine block including a wall having a recess formed therein; and (B) an auxiliary apparatus mounted on said wall and comprising a coolant pump, an oil cooler device, and an oil filter unit combined as a single unitary unit, wherein (1) said oil cooler device comprises a housing having an oil pathway and a coolant pathway formed therein, (2) said housing includes a mounting surface for attachment to said wall of said engine block, and wherein (3) said oil pathway and said coolant pathway both extend beyond said mounting surface to said recess in said wall.

15. A internal combustion engine as claimed in claim 14, wherein said housing of said oil cooler device includes an inner cover and an outer cover, wherein said oil pathway and said coolant pathway both are located partly within said outer cover with their remaining portions located within said inner cover, and wherein said inner cover is located within said recess and forms a portion of a coolant jacket of said engine.

16. An internal combustion engine as defined in claim 15, wherein said outer cover is attached to said cylinder block and clamps said inner cover in position within said recess.

17. An internal combustion engine as defined in claim 15, wherein said inner cover is formed by a wall of said engine.

18. An internal combustion engine as claimed in claim 15, wherein an aperture is formed in said inner cover and communicates directly with said engine coolant jacket.

* * * * *